United States Patent [19]

Lerner et al.

[11] Patent Number: 4,467,207

[45] Date of Patent: Aug. 21, 1984

[54] NON-MIGRATING CONTROL INDICIA FOR A PLASTIC WEB OR SHEET ARTICLE

[75] Inventors: Hershey Lerner, Hudson, Ohio; Harold Waitz, Berkeley, Calif.

[73] Assignee: Automated Packaging Systems, Inc., Twinsburg, Ohio

[21] Appl. No.: 394,121

[22] Filed: Jul. 1, 1982

Related U.S. Application Data

[63] Continuation of Ser. No. 166,499, Jul. 7, 1980, abandoned.

[51] Int. Cl.[3] ..... G01N 21/38

[52] U.S. Cl. ..... 250/459.1; 252/301.35; 252/301.21; 428/913; 428/500; 428/543; 428/195; 118/668; 118/712; 283/62

[58] Field of Search ..... 8/513, D9; 428/543, 428/195; 118/691, 712, 668; 73/36, 159; 282/301.21, 301.3 S; 250/459.1

[56] References Cited

U.S. PATENT DOCUMENTS

| | | | |
|---|---|---|---|
| 2,983,686 | 5/1961 | Konig | 252/301.3 S X |
| 3,115,417 | 12/1963 | Christensen | 252/301.35 X |
| 3,177,153 | 4/1965 | Pommer et al. | 252/301.21 |
| 3,671,451 | 6/1972 | Butterfield | 252/301.2 |
| 3,776,761 | 12/1973 | Kato et al. | 428/690 X |
| 3,892,972 | 7/1975 | Cevasco | 250/458 |
| 4,009,551 | 3/1977 | Greenawalt et al. | 53/28 |

OTHER PUBLICATIONS

Frados, Plastics Engineering Handbook, pp. 843–845, Van Nostrand, (1976).

Modern Plastics Encyclopedia, pp. 672–679, 446–447.

*Primary Examiner*—John D. Welsh

*Attorney, Agent, or Firm*—Watts, Hoffmann, Fisher & Heinke

[57] ABSTRACT

An article in web or sheet form, especially useful in the packaging or container art, having control indicia. The indicia are detectable under special conditions for controlling operations in the manufacture and/or use of the article. In the preferred embodiment the indicia are invisible and of a polar or ionic organic material that will not significantly migrate through a plastic web. The indicia emit electromagnetic wavelength-shifted radiation in response to incident electromagnetic radiation of a selected wavelength.

12 Claims, 9 Drawing Figures

NON-MIGRATING CONTROL INDICIA FOR A PLASTIC WEB OR SHEET ARTICLE

This is a continuation of application Ser. No. 166,449 filed July 7, 1980, abandoned.

BACKGROUND OF THE INVENTION

1. Field of the Invention

This invention relates to a web or sheet article wherein the article is encoded with information that controls operations performed on or with the article.

2. Prior Art

In the manufacture and/or use or of webs or sheets of material, it is important that certain manufacturing operations be accurately performed along the web length. A novel technique for web control is disclosed in copending U.S. patent Ser. No. 166,500 entitled "Continuous Web Registration", Hershey Lerner and Bernard Lerner, inventors, concurrently filed herewith. That application is incorporated herein by reference. According to the invention disclosed in that application a series of marks which emit visible or invisible electromagnetic wavelength-shifted radiation under an incident electromagnetic radiation are affixed to a web. The emitted radiation is of a different wavelength than the incident radiation and can be detected by a detector. Control circuitry coupled to the detector generates signals which can be used to control web manufacture and/or use.

Not all wavelength shifting materials are suitable for practice of the above invention. There have been proposals to use visible light detectors in conjunction with control marks which absorb ultraviolet light and emit visible light on articles other than webs. As an example, one proposal was to place a visible light emitting mark on a tube which, when detected by a visible light detector, was used to assist in rotational registration of the tube for sealing. The material that was used, however, emits visible light only in the presence of high energy ultraviolet light with a wavelength of about 2540 angstroms. Such high energy radiation can be damaging to the eye and therefore not suitable for use as a mark unless safety precautions are taken.

Other materials which emit visible light in response to less energetic electromagnetic energy are not suitable because they migrate through plastic. If control circuitry is to accurately determine a mark's position on a moving web, it is imperative that the material comprising the mark not bleed or migrate through the web surface so as to enlarge the mark. Migration may also cause a mark to flow through one layer of plastic web to another producing a mark where none was intended.

Although many materials which emit visible light radiation are known, the prior art does not teach any electromagnetic wavelength-shifting material for controlling the use and/or the manufacture of plastic webs, much less which materials would be especially suitable. Since electromagnetic wavelength-shifting control marks have never been affixed to plastic webs the problems that wavelength-shifting marks exhibit when used on plastic foils have never been recognized. Thus, there have been no successful proposals for marking a plastic sheet or web with materials that are readily detectable, i.e., that emit a visible or an invisible electromagnetic wavelength-shifted control signal, in response to non-harmful incident electromagnetic radiation, and remained in a fixed location on the web.

SUMMARY OF THE INVENTION

The present invention features a plastic foil, such as a sheet or web, having non-migrating control marks or indicia affixed to its surface. The presence of the marks can be detected by irradiating the web with non-harmful electromagnetic radiation. The marks respond by emitting wavelength-shifted electromagnetic radiation which can be detected by a detector. Circuitry coupled to the detector provides signals which then initiate web control operations.

A preferred mark includes an organic compound which emits wavelength-shifted radiation when exposed to incident electromagnetic radiation that is not harmful to the eye. The structure of the carbon atoms in the organic compound allows less energetic radiation to initiate re-radiation of a detectable nature. It is believed that this phenomena is due to the high energy of bound electrons shared between two or more carbon atoms. The high energy carbon electrons are excited into a high energy state by less energetic electromagnetic radiation.

To avoid mark migration through the web, the preferred organic compound is ionic or polar. This characteristic allows the compound to bond to either the plastic web or with a separate carrier substance which in turn bonds to the web. One class of organic compounds which emits wave-shifted electromagnetic radiation and does not migrate in plastic is ionic or polar stilbenes or derivatives of stilbenes. Compounds in this class have proven to be economical, emit detectable wavelength-shifted electromagnetic radiation in response to non-harmful incident electromagnetic radiation, and are soluble in a varnish which adheres to plastic. A preferred material is sold by Sandoz Colors and Chemicals Corporation under the tradename TH-40 and comprises a disulfonated diamino stilbene-triazine in liquid form.

While the preferred mark includes a disulfonated stilbene, any organic wavelength-shifting compound which does not migrate when affixed to a plastic is suitable. Electromagnetic wavelength-shifting materials such as TH-40, laser dyes, and biological dyes have all been used with success.

Other electromagnetic wavelength-shifting materials which typically do migrate in plastic have been modified to be compatible with plastic. Coumarins, for example, are non-ionic and therefore strongly migrate when affixed to plastic. A coumarin derivative which is ionic, however, will not bleed through plastic, such as polyethylene, which is an olefin nonpolar material, and may be used as a mark so long as the derivative emits wave-shifted electromagnetic radiation under non-harmful low-energy incident radiation. Benzoxazoles which are typically non-ionic may similarly be modified to become ionic and suitable as a mark.

In the preferred embodiment of the invention, the wavelength-shifting compound is added to a non-migrating varnish which comprises an alcohol, resin mixture. To be compatible with the varnish the compound must be soluble in it. Ionic compounds are typically water soluble or hydrophillic and therefore also soluble in the varnish.

Marks which include such compounds may be either transparent or camouflaged in use by a suitable background. If the marks are transparent they may be used on plastic webs which are either clear or colored. If the marks are visible they can be affixed on a background which conceals their presence from view.

From the above it is apparent that one object of the present invention is to utilize control marks with a plastic web which do not migrate when affixed to the web. Another object is the provision of a control mark which is readily detectable when exposed to incident non-harmfull electromagnetic radiation.

Other objects and features of the present invention will become better understood when considered in conjunction with the drawings and detailed description of a preferred embodiment which follows.

PREFERRED EMBODIMENT OF THE INVENTION

Figure 1:
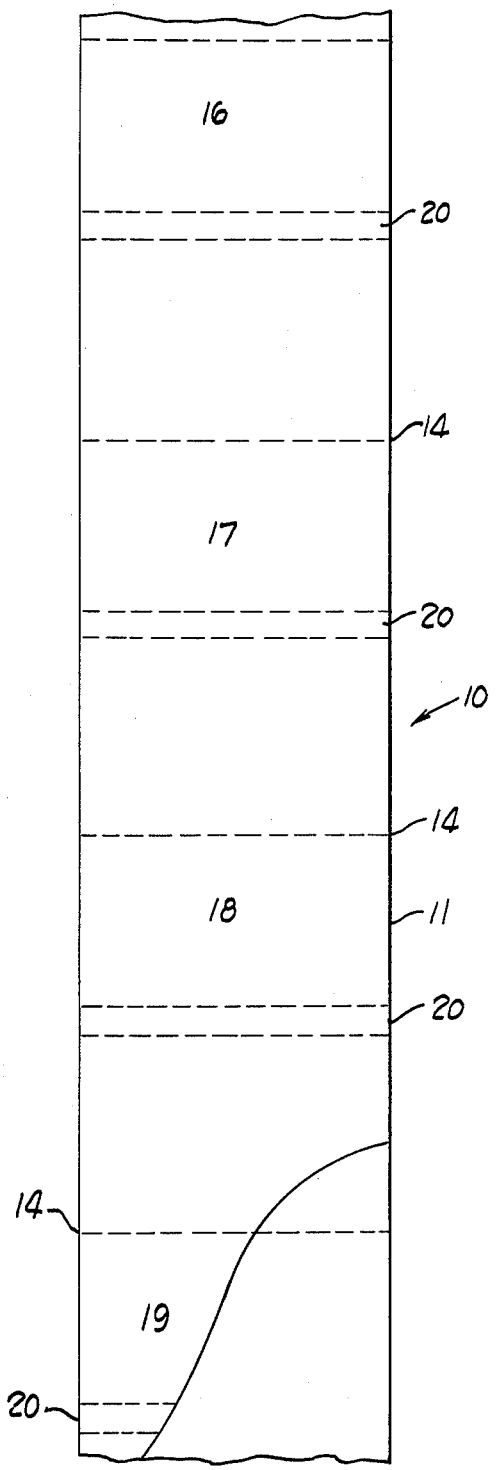
FIGS. 1–5 show plan views of elongated webs or sheets which include either transparent or camouflaged markings.

Referring now to the drawings and particularly FIG. 1, a plastic heat sealable article of manufacture 10 comprising a double ply web 11 is illustrated. Each ply is segmented along its length by a series of laterally extending perforations 14 to form a series of sleeve segments 16–19.

Each sleeve segment is heat sealed along its edges and when disconnected from the web can be used as a label which slips over a bottle or other object. The segments 16–19 illustrated in FIG. 1 are clear plastic with no printing or design yet added.

Extending across each segment at approximately the midway point between the perforations 14 is a transparent colorless marking 20 shown in phantom in FIG. 1. When exposed to incident electromagnetic radiation of an appropriate wavelength the marking 20 emits a wavelength-shifted electromagnetic output to allow detection of the presence of the mark. In the preferred embodiment the mark is invisible under daylight and emits wavelength-shifted radiation in response to non-harmful incident electromagnetic radiation.

The repetitive markings 20 are used both in fabricating the series of sleeves from a web and in use of the web of fabricated sleeves at locations removed from the fabricating location. During the fabricating process, for example, the markings 20 are used to coordinate application of the perforations 14 as the web moves past a cutting station. Once the double ply web has been perforated it is typically stored on rolls for transportation to a separate facility where the segmented sleeves are applied to bottles or other cylindrical containers. During such a label application process the markings 20 can be used to initiate and control the application of the segmented sleeves to the bottles.

Other webs, including single ply foils, may be manufactured utilizing a transparent mark for control purposes but in a slightly different format. One alternate embodiment (FIG. 2) comprises a double ply web 11' segmented by perforations 14' in a series of connected sleeves but wherein the marks do not extend across the width of the web and where more than one mark is applied to each segmented sleeve.

Figure 2:
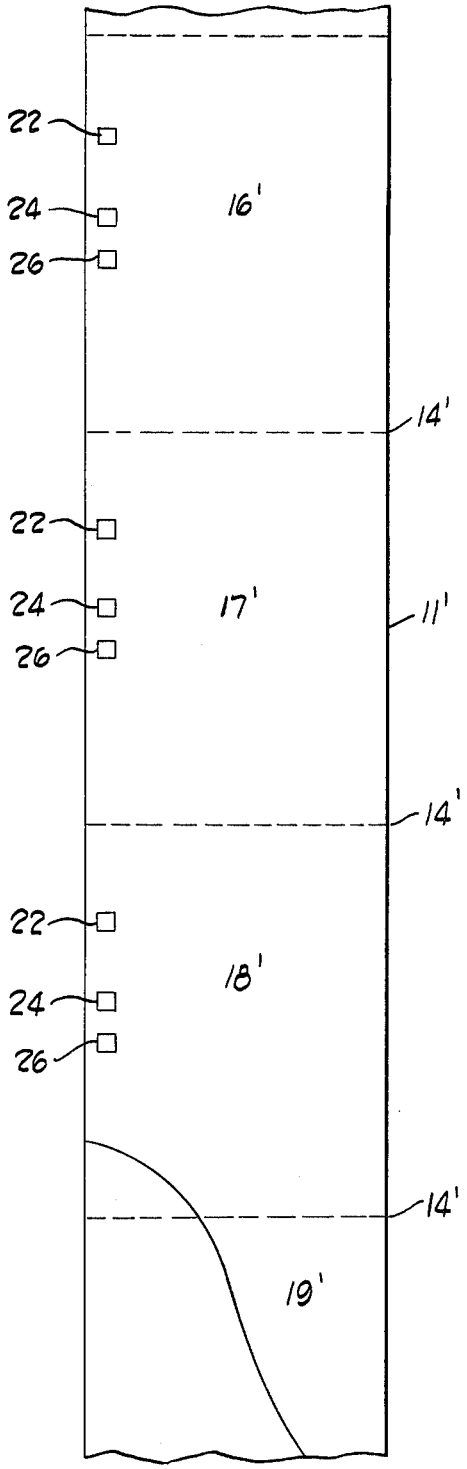

The web construction shown in FIG. 2 has three distinct marks 22, 24, 26 applied to each sleeve segment. The embodiment shown in FIG. 2 comprises a clear plastic web and the markings are again transparent but emit wave-shifted electromagnetic radiation under incident low energy electromagnetic radiation of a non-harmful wavelength.

Figure 3:
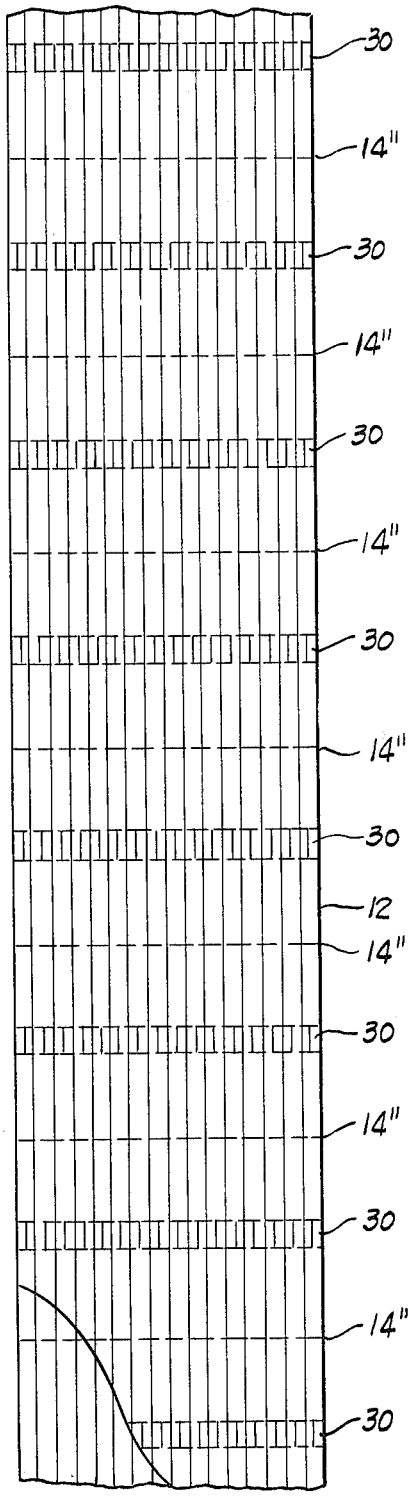
Figure 4:
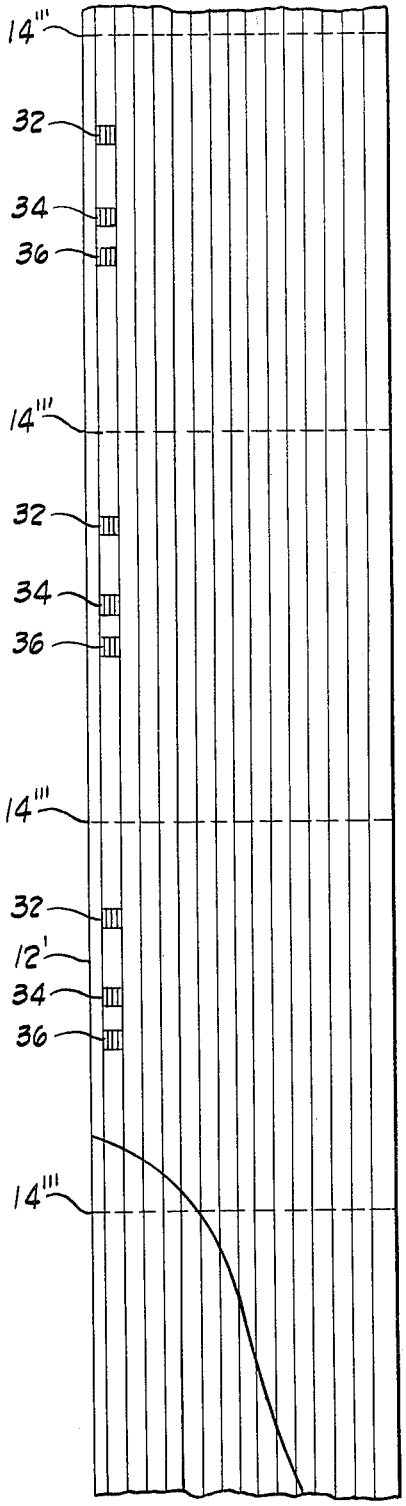

In many applications it is desirable that a printing or design be applied to a web before manufacturing and/or production processes are performed on the web. In instances where a significant portion of a web is opaque or colored, it is not absolutely necessary that the marks be transparent to avoid being visible, since it is possible to camouflage the marks on the opaque or colored background. The materials shown in FIGS. 3 and 4 are colored double ply, i.e., tubular, segmented, webs 12 and 12' which comprise a series of connected sleeves. The webs are lined to indicate the color red but other colored webs can similarly be controlled using camouflaged marks. Control marks affixed to such webs may be visible but should be of such a material that upon receipt of a particular electromagnetic radiation generate or emit electromagnetic radiation of a wave shifted nature.

As in the case of transparent webs the printed webs may include any marking scheme. Thus, the FIG. 3 web 12 includes a laterally extending line or mark 30 across the width of the web and the web 12' shown in FIG. 4 includes a series of three discrete marks 32, 34, 36 along the edge of an uppermost web ply. The markings have been lined to indicate they are red and thus are camouflaged by the red webs.

Figure 5:
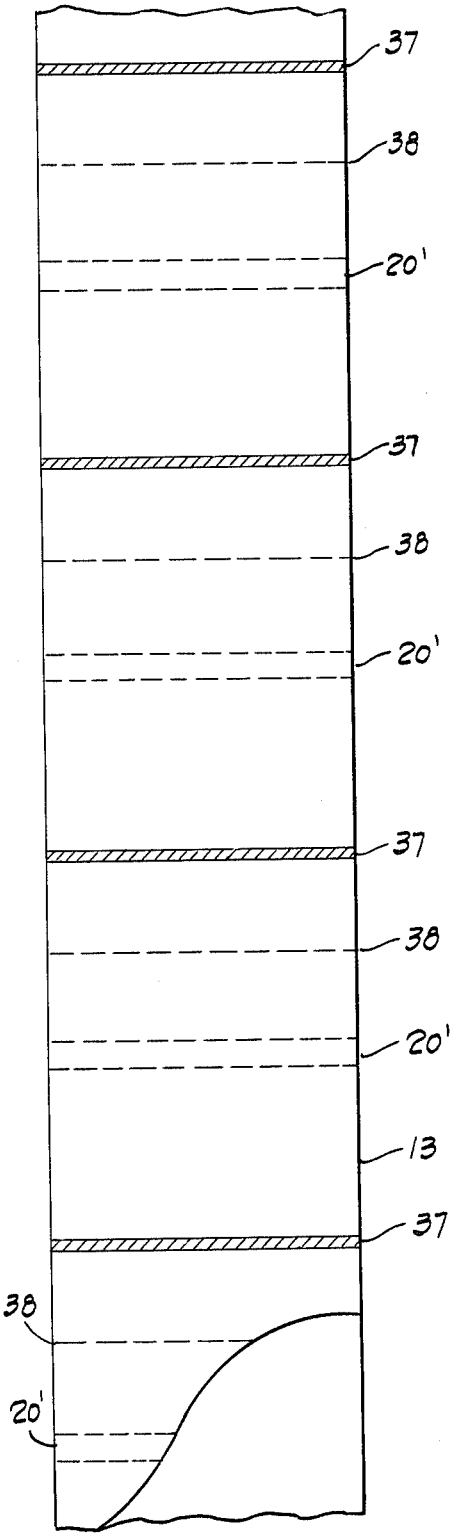

It should be appreciated that the present invention is not limited to use in conjunction with perforated webs of plastic sleeves or plastic foils of any particular number of plys. FIG. 5 shows a web structure 13 comprising a series of connected plastic bags separated by heat seals 37. Each bag includes a single ply perforation 38 which forms an opening to the bag. Extending across one ply of each bag is also a transparent wave shifting marking 20' similar to the marking 20 shown in FIG. 1, which allows detection of the presence of that marking as the web moves past an appropriate detector. As was the case for the sleeves shown in FIGS. 1–4, a series of bags may include areas of printing, in which case the markings may be colored and camouflaged. It should also be apparent that other designs for that marking could be chosen and in particular a series of discrete markings could be applied to the bag. As illustrated the bags are all separated by the heat seals 37. The markings 20' might therefore be used to control application of a series of perforations through the seals 37 to allow the bags to be separated. The markings might also be affixed to a foil in a non-consistent or non-repetitive pattern so as to allow random operations to be performed to the foil.

The preferred marking material for plastic webs made from low density polyethylene, which is an olefinic nonpolar material, or other similar heat sealable materials is an ink comprising 93% varnish, 4% Sandoz TH-40 and 3% wax. The Sandoz TH-40 is the wavelength-shifting material and includes a disulfonated diamino stilbene-triazine in liquid form. It is commercially available from Sandoz Colors and Chemical Corporation. The wax is available from the Inmont Company under the designation 72 F9105. The varnish is a resin, alcohol mixture which in the preferred embodiment is 40% Versamid 712 and 60% alcohol. The line markings 20, 30 and 20' illustrated in FIGS. 1, 3, and 5 are affixed using a 100 line analox printing roller. Ink comprising these materials is colorless, transparent, non-migrating in plastic and emits wavelength-shifted electromagnetic radiation under incident radiation of about 3660 angstroms to produce radiation of about 4500 angstroms.

Other wavelength-shifting stilbene compounds have proven to be compatible with plastic. A second stilbene compound sold under the tradename Phorite CL by the Verona Dyestuff division of the Mobay Chemical Corporation has provided acceptable emission when it comprises 3% of the ink. The Phorite CL is a stilbene disulfonic acid derivative in liquid form. A third stilbene marketed by the Mobay Chemical Corporation, which is suitable as a mark, is sold under the name Phorite BA.

Although all three stilbene compounds emit wavelength-shifted radiation in the visible range of the light spectrum, other ionic organic compounds which emit wavelength-shifted radiation have also been used with success. Ionic, organic laser dyes have proven acceptable. Thus, in the embodiment where the mark emits wavelength-shifted radiation in the non-visible range, a laser dye marketed by the Eastman Kodak Corporation with the designation KODAK I.R.-125 is substituted in the ink. IR-125 is a dark red organic and ionic compound that is soluble in the varnish and that emits invisible radiation of about 9400 angstroms when irradiated with radiation having a wavelength of about 7950 angstroms. Although sold under the name IR-125, this material is an anhydro1, 1 dimethyl-2-(7-(1,1-dimethyl-3-(4-sulfobutyl)-2-(1H)-benz(e)indolinylidene)-1,3,5-heptatrienyl)3-(4-sulfobutyl)-1H-benz(e)indolium with a molecular formula $C_{43}H_{47}N_2NaO_6S_2$.

A second example of a non-migrating ionic laser dye is 8-hydroxy-1, 3, 6 pyrenetrisulfonic acid trisodium salt which is also available from the Eastman Kodak Company. This material is of a blue color which is soluble in the varnish and emits electromagnetic radiation of a wave shifted nature.

A number of ionic biological dyes have also been found to be suitable as marking materials. These dyes are water soluble organic dyes which do not migrate in the plastic when used with the preferred varnish. Three examples of these biological dyes are soluble fluorescein, which is a disodium salt sold by the Aldrich Chemical Company; 8-anilino-1-napthalene sulfonic acid magnesium salt; and 6-(p-toluidino-Z napthalene sulfonic acid potassium salt. The latter two are commercially available under the names 1-8 ANS magnesium salt and 2, 6 - TNS potassium salt respectively.

Non-ionic organic wavelength-shifting compounds can be modified slightly to make them ionic and therefore non-migrating. Coumarins, for example, normally migrate in plastic. An example of a non-migrating coumarin derivative, however, is 4-methyl-7-(sulfo methyl amino) coumarin sodium salt. When dissolved in the varnish described this material is clear and emits at 4750 angstroms under incident radiation of 3660 anstroms.

All the above materials may be used on plastic foils to generate control signals. Marks of these materials do not migrate in plastic foils and respond to radiation not harmful to the eye. Since the Sandoz Th-40 is less expensive than the other materials it is the preferred mark material.

Figure 6:
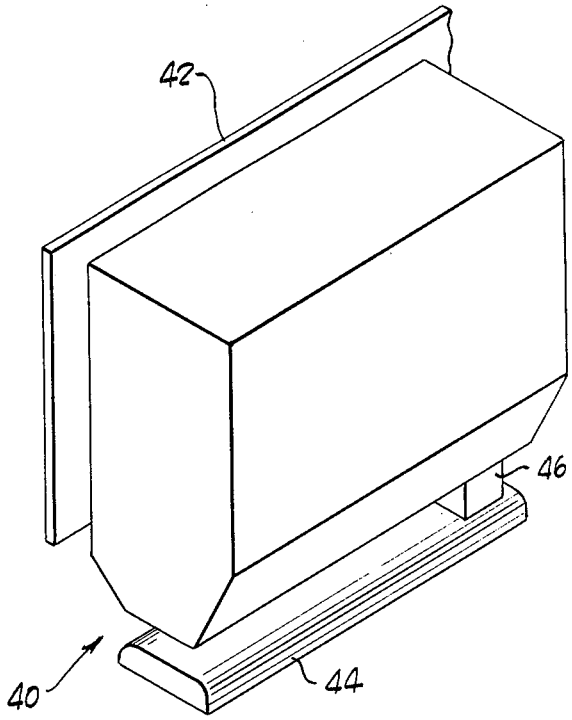
FIG. 6 shows a perspective view of a detector for controlling fabrication and/or use of the web disclosed in FIGS. 1–5 by detecting the presence of the markings.
Figure 8:
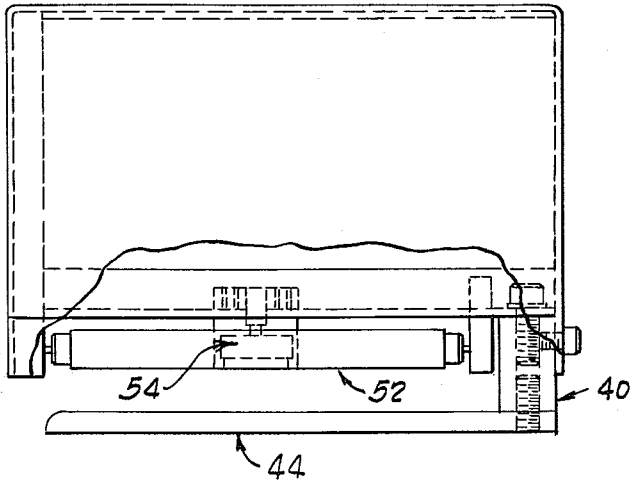
FIGS. 7 and 8 or partially sectioned elevational views of the detector shown in FIG. 6.
Figure 7:
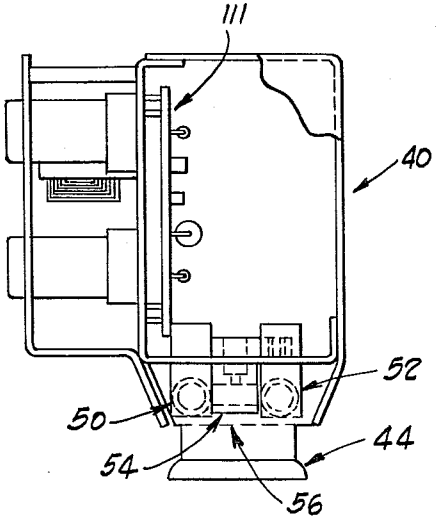
Figure 9:
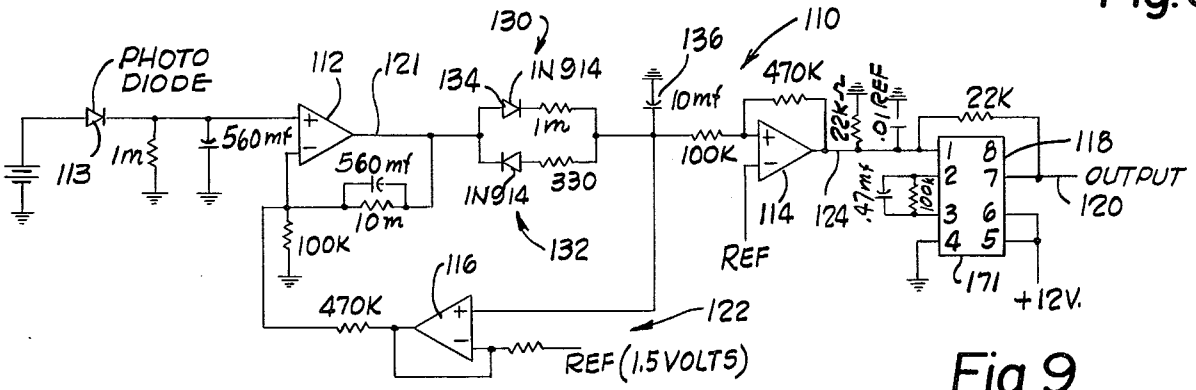
FIG. 9 shows control circuitry mounted within the detector for generating control signals in response to the detecting of the markings.

A preferred detector unit 40 for detecting the presence of markings along a web is shown in FIG. 6. This unit is mounted in proximity to a moving web by a detector mounting plate 42. The web is caused to move beneath the detector by an appropriate drive (not shown). A web guide 44 is positioned beneath the detector 40 and is attached to it by a suitable support 46. This guide 44 allows the web to pass beneath the detector at a distance close enough to allow the detector to sense the presence of the marking on the web. Control circuitry 110 mounted inside the unit 40 (see FIG. 7) generates signals which control fabrication or manufacturing processes to be performed to the moving web.

Mounted inside the detector unit are two sources 50, 52 of incident electromagnetic radiation. Positioned between these sources is a detector 54 which senses the presence of markings on the web as the web passes over the web guide 44. In operation, the sources 50, 52 direct electromagnetic radiation of about 3660 angstroms to the web directly beneath the detector 54. When the incident radiation strikes a mark it causes a wavelength-shifted output to be emitted from that mark.

Interposed between the web and the detector is a filter 56 for filtering out electromagnetic radiation of wavelengths other than the wavelengths emitted by the marking. The filter enhances sensitivity by preventing radiation reflected from the web from reaching the detector. More specifically the filter sufficiently blocks transmission of reflected mark-stimulating radiation so that such reflections will not cause false signals when marks are not present. Reflection of electromagnetic radiation that is ambient to the machine is not a problem because its intensity, in any location occupied by humans, is not high enough to cause reflections which will cause the detector to emit false signals. Mark detection is enhanced by constructing the web guide support 46 to be adjustable to allow the distance between the web and the detector 54 to be optimized.

Exemplary circuitry 110 for generating control voltages in response to the presence of the web markings is shown mounted inside the detector unit 40 on a printed circuit board 111. That circuitry 110 is electrically connected to a photo diode 113 in the detector 54. Three amplifiers 112, 114, 116 and a timer 118 respond to changes in photo diode resistance with changes in electromagnetic radiation intensity from the marking to generate a control output 120.

As radiation from a mark impinges on the photo diode with increasing intensity the resistance of the diode decreases. The anode of that diode 113 is connected to a 12 volt source and the cathode coupled to a 1 megohm resistor. As the resistance decreases the current through the 1 megohm resistor increases causing a larger voltage to appear at a non-inverting (+) input to the first amplifier 112. This amplifier 112, is an operational amplifier and one suitable such amplifier is an LM324 op amp.

An output 121 from the first operational amplifier 112 is coupled to a second operational amplifier 114 and further coupled to the inverting input of the first op amp 112 through a feedback network 122.

The second operational amplifier 114 responds to the output 121 from the first amplifier 112. This second op amp 114 includes a reference input and a non-inverting input. When the non-inverting input signal is greater than the reference signal, an output 124 from the second operational amplifier 114 goes high. This output 124 is coupled to an industrial timer 118 which serves to shape the irregular shaped output 124 from the second amplifier 114 into a well defined signal of constant height and pulse width. The pulse width is determined by an RC network coupled across pins 2 and 3 of the timer. In the embodiment illstrated the pulse width is 0.047 seconds. The illustrated timer is a National Semiconductor LM 2905 timer. In operation, as the photo diode's resistance drops in response to increased radiation intensity, the output 124 goes high and a well defined voltage output from the timer is generated which can be used for control purposes.

A problem has developed in sensing the output from the markings due to the difference in background radiation intensity with changes in the type and color of the background material supporting the markings. A light colored or transparent web produces a higher level of ambient or background radiation than a dark colored web so that markings attached to a dark background may provide less intense detectable radiation than an area with no markings but with a light background. For this reason the circuitry must be sensitive to changes in intensity and not to absolute intensity levels. The feedback network 122 provides this capability.

The feedback network 122 comprises two parallel connected diode, resistor circuits 130, 132 and the third amplifier 116. As the output from the first amplifier increases one diode 134 conducts through a 1 megohm resistor and charges a 10u farad capacitor 136. As that capacitor charges its voltage increases. This voltage is coupled to the third amplifier 116 and is transmitted by that gain of one amplifier to the inverting input of the first amplifier 112.

If the output from the first amplifier changes slowly due to changes in ambient radiation levels the capacitor 136 will charge slowly and the feedback input to the first amplifier's inverting input will also change slowly, trailing the non-inverting input to the first amplifier. Since the output from the first amplifier is the difference in value between its two inputs the signal transmitted to the second amplifier 114 is constant or relatively so.

A sharp, sudden rise of the output from the first amplifier 112 due to a sudden change in the current through the diode 113 causes a large signal to appear to the non-inverting input to the second amplifier 114 which triggers an output on the timer 118. The capacitor 136 cannot charge rapidly enough to significantly change the input to the third amplifier 116. The inverting input on the first amplifier does not change and therefore the difference between the two inputs remains large.

From the above it is apparent that the circuitry 110 is sensitive to rapid changes in radiation intensity and not gradual changes in ambient radiation intensity. The intensity changes necessary to actuate the output are determined by the reference input to the second amplifier 114 and can be varied according to the specific system being controlled. In the preferred and illustrated embodiment the reference input is about 1.2 volts.

The 0.047 second output from the timer 118 signifies the presence of a control mark beneath the detector 54. Since this output may not be compatible with a particular control system it may be used to generate suitable control signals which are compatible with a particular control.

Irrespective of which wavelength-shifting control indicia is used the detector arrangement remains substantially unmodified. For example, in the embodiment where IR-125 is used in the ink, the filter 56 should be a 9050 angstrom ban filter. The incident radiation must be in the 7950 angstrom range and can be generated by passing incandescent radiation through a 7560 angstrom band filter or using an infrared source that radiates 7950 angstrom radiation.

While a preferred embodiment of the invention has been disclosed in detail, various modifications or alterations may be made herein without departing from the spirit or scope of the invention set forth in the appended claims.

What is claimed is:

1. A method for controlling operations to an article of manufacture comprising the steps of:

(a) affixing an essentially non-migrating mark of organic ionic or polar material to a heat-sealable polyolefin plastic foil, which mark responds to incident electromagnetic radiation by emitting electromagnetic radiation of a different wavelength;

(b) detecting the presence of said mark by sensing the presence of said emitted electromagnetic radiation; and (c) performing operations to said foil in response to the detection of said mark.

2. A web of thermoplastic polyolefin material, which fuses under application of heat and pressure, suitable for fabrication into a series of connected but separable articles and carrying a series of marks of organic polar or ionic material that essentially do not migrate in the web and which emit wavelength-shifted radiation when exposed to incident electromagnetic radiation.

3. A web capable of being moved along a path relative to an operating mechanism, said web comprising a thermoplastic polyolefin material, which fuses under application of heat and pressure, suitable for operations including at least heat sealing into a series of articles useful as at least a part of a container, and indicia at locations on said web correlated with said articles for controlling operations of the mechanism upon the web, said indicia being comprised of a polar or ionic organic material which emits wavelength-shifted radiation under electromagnetic radiation in the nonvisible spectrum, that essentially does not migrate in the web, and that is essentially invisible to the human eye under electromagnetic radiation in the visible spectrum, and detectable to control the operating mechanism.

4. An article useful in the packaging or container art and capable of being moved along a path relative to a fabricating mechanism, said article comprising a sheet or web of thermoplastic polyolefin material to be fabricated, which fuses under application of heat and pressure, and indicia carried by the article for controlling the fabrication, said indicia being comprised of an organic polar or ionic material that emits wavelength-shifted radiation under incident electromagnetic radiation and that is essentially non-migrating in said plastic material and that is essentially invisible to the human eye under electromagnetic radiation in the visible spectrum.

5. The article of claim 4 wherein the organic material is a stilbene or a derivative of a stilbene, or a derivative of a coumarin.

6. An article of manufacture comprising a thermoplastic polyolefin foil, which fuses under application of heat and pressure, and a mark on the foil, said mark being comprised of an organic ionic or polar material which responds to incident electromagnetic radiation by emitting radiation of a different wavelength to allow detection of the presence of said mark.

7. An article of manufacture as set forth in claim 6 wherein the foil comprises a web suitable for fabrication into a series of articles by fabrication apparatuses which respond to the detection of said mark.

8. An article of manufacture as set forth in claim 6 wherein both the incident radiation and the radiation emitted by the material are non-visible.

9. An article as set forth in claim 6 wherein the mark is essentially invisible when inspected under daylight illumination.

10. An article of manufacture comprising a polyethylene heat sealable thermoplastic foil, which fuses under application of heat and pressure, and a mark on the foil, said mark comprising, an ionic disulfonated diamino stilbene-triazine derivative, which responds to electromagnetic radiation by emitting radiation of a different wavelength to allow detection of the presence of said mark.

11. An article useful in the packaging or container art and capable of being moved along a path relative to a sensing mechanism, said article being comprised of thermoplastic polyolefin foil, which fuses under application of heat and pressure, and a mark carried by the foil for being sensed by said mechanism, said mark being comprised of an organic polar or ionic material that essentially does not migrate in said thermoplastic foil, that emits wavelength-shifted radiation under incident electromagnetic radiation, and that is essentially invisible to the human eye under electromagnetic radiation in the visible spectrum.

12. An article as set forth in claim 11 wherein said foil is polyethylene.

* * * * *